US007162748B2

(12) United States Patent
Hottner et al.

(10) Patent No.: US 7,162,748 B2
(45) Date of Patent: Jan. 16, 2007

(54) HANDCOVERING

(76) Inventors: Martin Hottner, Sperberstr. 31, D-83052 Bruckmühl (DE); Ulrich Spindler, Mooshappener Str. 1, D-83254 Breitbrunn (DE)

( * ) Notice: Subject to any disclaimer, the term of this patent is extended or adjusted under 35 U.S.C. 154(b) by 336 days.

(21) Appl. No.: 10/182,356

(22) PCT Filed: Feb. 2, 2001

(86) PCT No.: PCT/EP01/01124

§ 371 (c)(1),
(2), (4) Date: Nov. 25, 2002

(87) PCT Pub. No.: WO01/56415

PCT Pub. Date: Aug. 9, 2001

(65) Prior Publication Data

US 2004/0098786 A1 May 27, 2004

(30) Foreign Application Priority Data

Feb. 2, 2000 (DE) ..... 100 04 355

(51) Int. Cl.
*A41D 19/00* (2006.01)

(52) U.S. Cl. ..... 2/161.6; 428/289

(58) Field of Classification Search ..... 2/161.1, 2/161.6, 164, 169; 442/289, 397, 76, 77, 442/182, 183, 328, 329
See application file for complete search history.

(56) References Cited

U.S. PATENT DOCUMENTS

| | | | | |
|---|---|---|---|---|
| 3,953,566 A | | 4/1976 | Gore | 264/288 |
| 4,194,041 A | | 3/1980 | Gore et al. | 428/315 |
| 4,430,759 A | * | 2/1984 | Jackrel | 2/159 |
| 4,776,209 A | | 10/1988 | Patchel | 73/45.5 |
| 4,847,918 A | * | 7/1989 | Sturm | 2/161.6 |
| 5,255,716 A | | 10/1993 | Wilcox | 138/44 |
| 5,349,705 A | * | 9/1994 | Ragan | 2/161.6 |
| 5,442,818 A | * | 8/1995 | Loos | 2/272 |
| 5,566,405 A | * | 10/1996 | Masley | 2/169 |
| 5,732,413 A | * | 3/1998 | Williams | 2/169 |
| 5,740,551 A | * | 4/1998 | Walker | 2/16 |
| 5,911,313 A | * | 6/1999 | Gold | 2/159 |
| 5,981,019 A | * | 11/1999 | Goodwin et al. | 428/76 |
| 6,154,886 A | * | 12/2000 | Hottner | 2/169 |
| 6,716,778 B1 | * | 4/2004 | Hottner | 442/199 |

FOREIGN PATENT DOCUMENTS

| | | |
|---|---|---|
| DE | G 87 15 686.4 | 2/1988 |
| WO | WO 92/07480 | 5/1992 |
| WO | WO 97/16082 | 5/1997 |
| WO | WO 97/22385 | 6/1997 |

* cited by examiner

*Primary Examiner*—Katherine Moran
(74) *Attorney, Agent, or Firm*—Kevin J. Boland

(57) ABSTRACT

Handcovering, i.e. glove (72) or mitten, comprising an outer shell (50) and an inner glove insert (52) adhered to the shell (50). The glove insert (52) comprises a lining fabric laminated to a functional layer (42) that is water vapor permeable waterproof. The inner glove insert (52) is substantially free of folds or bunching of the insert (52) inside the glove (72).

22 Claims, 8 Drawing Sheets

Fig. 9
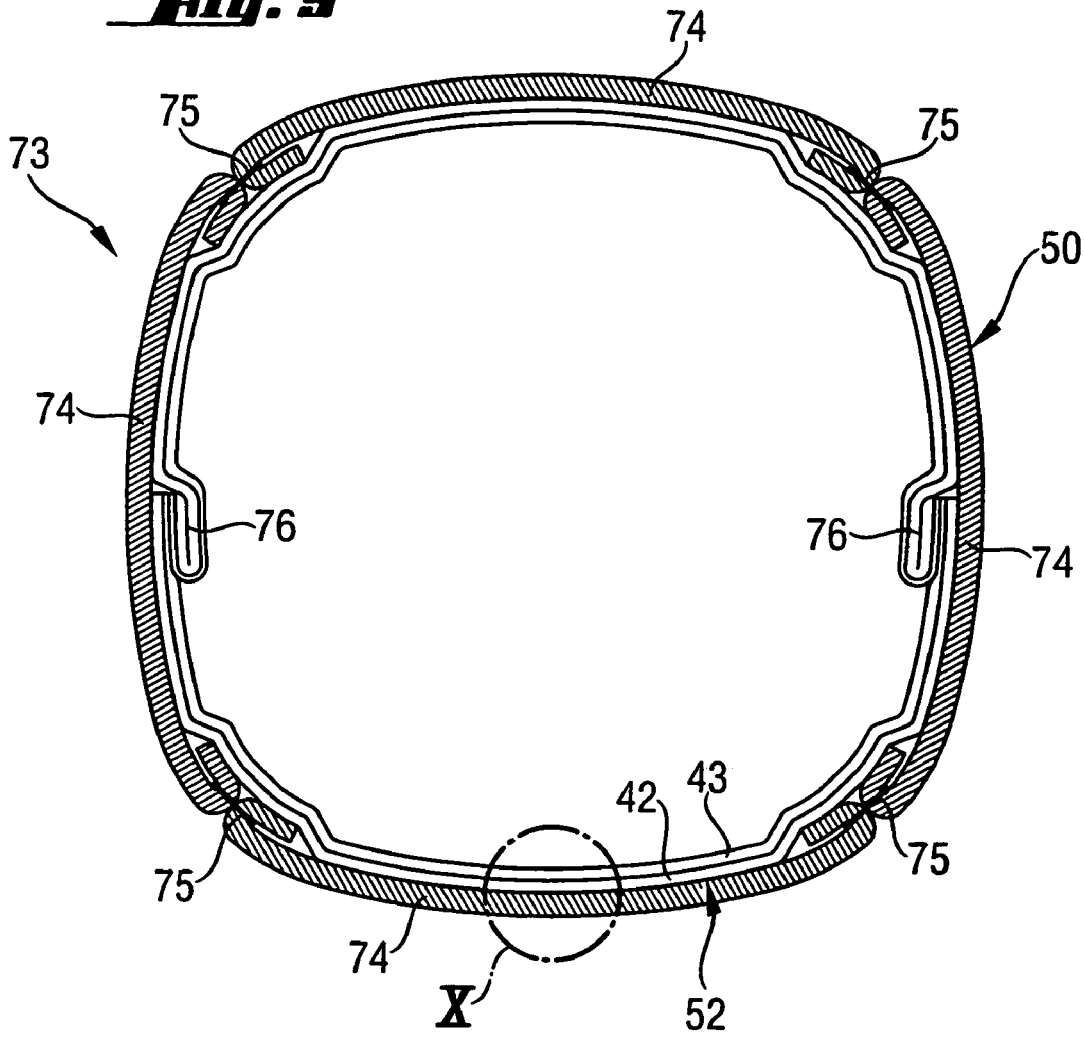
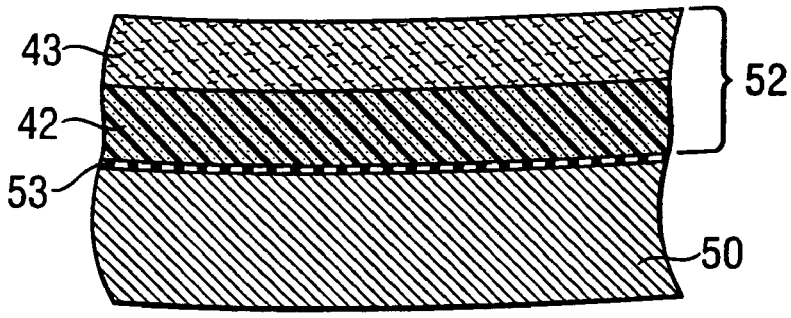
Fig. 10

HANDCOVERING

FIELD OF THE INVENTION

This invention relates to handcovering or handwear, such as gloves or mittens, comprising an outer protective layer and a waterproof inner insert layer.

BACKGROUND OF THE INVENTION

Attempts have been made to waterproof handcoverings, for gloves made of leather or fabric which are not waterproof. Gloves can be waterproofed by providing a waterproof lining or insert inside the outer shell layer of the glove. Frequently, for added comfort, the waterproof lining is usually also permeable to water vapor, i.e., it is breathable. This waterproof insert is sometimes referred to as a functional layer or material, it can be made a) of functional layer alone or b) made of a two-layer laminate comprised of a functional layer material and a cloth lining or textile backing or c) made of a three-layer material which is made of the functional layer material, the inner textile layer end a textile backing. For a comfortable feeling on the skin either there is a stitched together cloth lining inside the insert, or the inner textile layer of t he laminate is made of lining material. For easy and cost efficient production, these inserts usually consist of two counter equal, flat pieces of the functional layer or laminate which are sealed along the edge. The pattern has the shape of a two dimensional oversized hand.

Gloves comprising a shell and an insert that contains a functional layer are known. The said two dimensional pattern of the insert can not be brought into the three-dimensional shape of the glove shell without being folded somehow. In insulated gloves this is a minor problem since the additional insulation between the functional insert and the in this case thick cloth lining prevents the wearer from perceiving the folds.

In thin, non-insulated gloves which are tailored close to the shape of the hand the folds of the insert lead to substantial disadvantages. They can disturbingly be perceived by the wearer. The folds are not attached to each other thus giving the hand some slip within the glove which may be dangerous for the wearer in activities needing a good grip. Furthermore, they reduce the tactility by the added thickness what is crucial for activities needing a fine sensation. Furthermore, they increase the resistance of the glove to heat and moisture transfer, which is not wanted in gloves worn in warmer ambient conditions. Examples for such gloves are gloves for working, for motorcycling, and for golf.

A lot of attempts have been made to overcome these deficiencies. An example is U.S. Pat. No. 5,442,818 in which a three-dimensional shaped lining inside and a two dimensional, folded up insert made out of a laminate are joined in a "slip-proof" fashion with an adhesive thus leading to a three-dimensional inner glove. The folds of the two dimensional insert between the cloth lining and the shell are tolerated by covering them behind a three-dimensional shaped sewn lining. However, the system does not solve the problem of bulkiness and of high resistances for heat and moisture transfer. This is due to the many layers which are created by the still existing insert folds.

U.S. Pat. No. 5,255,716 is another patent that describes a two-layered material, namely a puckered functional or barrier layer adhered to a second extendable fabric layer, which two-layered material is then secured to an outer extendable fabric layer with an adhesive. In U.S. Pat. No. 5,255,716, the fabric layer is stretchable and is adhered in a manner that results in bunching up of the functional layer. This results in unnecessary thickness of the compounded layers. Hence, the resistance to heat and moisture transfere is not minimized. The added insulation value has even been mentioned by U.S. Pat. No. 5,255,716 as benefit which is only true when insulation is a wished property of the glove (page 13 line 28ff). Also, the elasticity of the wrinkles combined with the thickness of the wrinkled layer reduces the tactility perceivably.

Furthermore, U.S. Pat. No. 5,255,716 claims non elastic glove shells made e.g. from leather. However, with the described process it is not possible to make such a glove since the shell has to be drawn over a flat two dimensional former, which is formed in a way that requires extreme elasticity of the shell since the opening of the glove needs to stretched to fit over the wider fingerpart (page 47 line 3 ff). This is an inherent problem of the procedure and can not be solved by a change of the flat two dimensional former since the added circumferences of the fingers are larger than the circumference of the hand in the palm area and, therefore, the former has always to be wider at the fingers than at the palm area to completely stretch the whole glove, which is in the described procedure necessary to be able to adhere the glove over the complete surface.

SUMMARY OF THE INVENTION

This invention overcomes the deficiencies described in the prior art, especially with respect to minimizing the thickness of the complete assembled glove in order to optimize tactility, grip, breathability, heat transfer, and softness by providing in a broad aspect, a handcovering comprising: an outer material part or outer shell that is substantially non-elastic, e.g. made from such materials as leather or woven fabrics, and an inner part or inner glove insert adhered to the shell. The inner glove insert comprises a functional layer that is water vapor permeable and waterproof, the inner glove insert being substantially free of folds in the whole glove and having substantially no bunching of the functional layer, preferably no bunching at all.

The invention provides a handcovering with an outer material part and with an inner part, wherein the inner part is composed of a stretchable laminate which comprises a waterproof functional layer permeable to water vapor and a textile layer and which comprises an outer face; the outer material part has a three-dimensional shape corresponding to a hand and a correspondingly three-dimensional inner face; the inner part is stretched into the three-dimensional inner face of the outer material part in such a way that essentially the entire outer face of the inner part rests against the inner face of the outer material part; essentially the entire outer face of the inner part is bonded essentially to the entire inner face of the outer material part; and the outer material part is composed of an essentially inelastic outer material which is capable of absorbing restoring forces of the laminate which are caused by the stretching of the inner part.

The invention also provides a method for producing handcovering with an outer material part and with an inner part, having the following method steps: production of the outer material part having a three-dimensional shape corresponding to a hand and with a correspondingly three-dimensional inner face; production of the inner part having a two-dimensional stretchable laminate which has a waterproof functional layer permeable to water vapor and a textile ply and which possesses an outer face; stretching of the inner part into the three-dimensional inner face of the outer material part in such a way that essentially the entire outer face of the inner part comes to rest against the inner face of the outer material part; and bonding of essentially the entire outer face of the inner part to essentially the entire inner face of the outer material part; wherein the outer material part is composed of an essentially inelastic outer material which is capable of absorbing restoring forces of the laminate which are caused by the stretching of the inner part.

The handcovering is prepared by providing a laminate of the functional layer, e.g., porous PTFE film, that has preferably been treated on one surface with a polyurethane that is nonporous but which allows passage through it of water molecules, and a cloth lining laminated on the film. The laminate can optionally have a protective textile backing. The laminate is stretchable to a greater size. The cloth lining and the protective backing can be any textile or foam, e.g. made of polyurethane or polyester. Preferably, the cloth lining and the protective textile backing will comprise a knit. The cloth lining and the protective textile backing may be made of a polyethylene terephthalate, polyamide, viscose, cotton or blends of one or more of these materials.

To form the insert, two such laminates are superimposed and then sealed at an outline that is in the shape of a mitten or glove and then cut around the periphery to form a hand covering insert. The shape can be undersized in certain hand areas.

An adhesive is then applied to each outer surface of the insert. The adhesive can be applied in dot fashion, as a web or continuously. The adhesive can alternatively be applied on the laminate before the insert is sealed.

The insert is then placed inside an outer shell and heat is applied to cause the adhesive to adhere the insert to the inside of the shell by the means of a heated thumb form and a heated four finger hand form. It is usually preferred to heat the thumb portions first in order to secure the insert and the shell in the right position to one another and to prevent slippage as the procedure is carried out. Due to the three-dimensional shape of the shell, the insert is stretched in some areas to conform to the three-dimensional shape of the shell, and the two dimensional insert is reshaped into the three-dimensional shape of the shell substantially without folds being formed, and then the insert is adhered in this shape to the glove shell. Once initial adherence is obtained on the whole inner surface, air can be supplied to the interior to a) to press the insert firmly against the shell, b) cool the adhesive and c) to remove the glove from the heated handform without much friction.

In embodiments of the invention, the handwear or handcovering is in the form of a glove or a mitten.

In embodiments of the invention, the handwear or handcovering is in the form of an insulated glove or mitten or in the form of a thin, non-insulated glove.

BRIEF DESCRIPTION OF THE DRAWINGS

FIG. 9 depicts a cross section of a finger of the finished glove along section line IX—IX in FIG. 8. FIG. 10 depicts in magnified scale the layered structure in encircled region X in FIG. 9.

DETAILED DESCRIPTION OF EMBODIMENTS OF THE INVENTION

Figure 1:
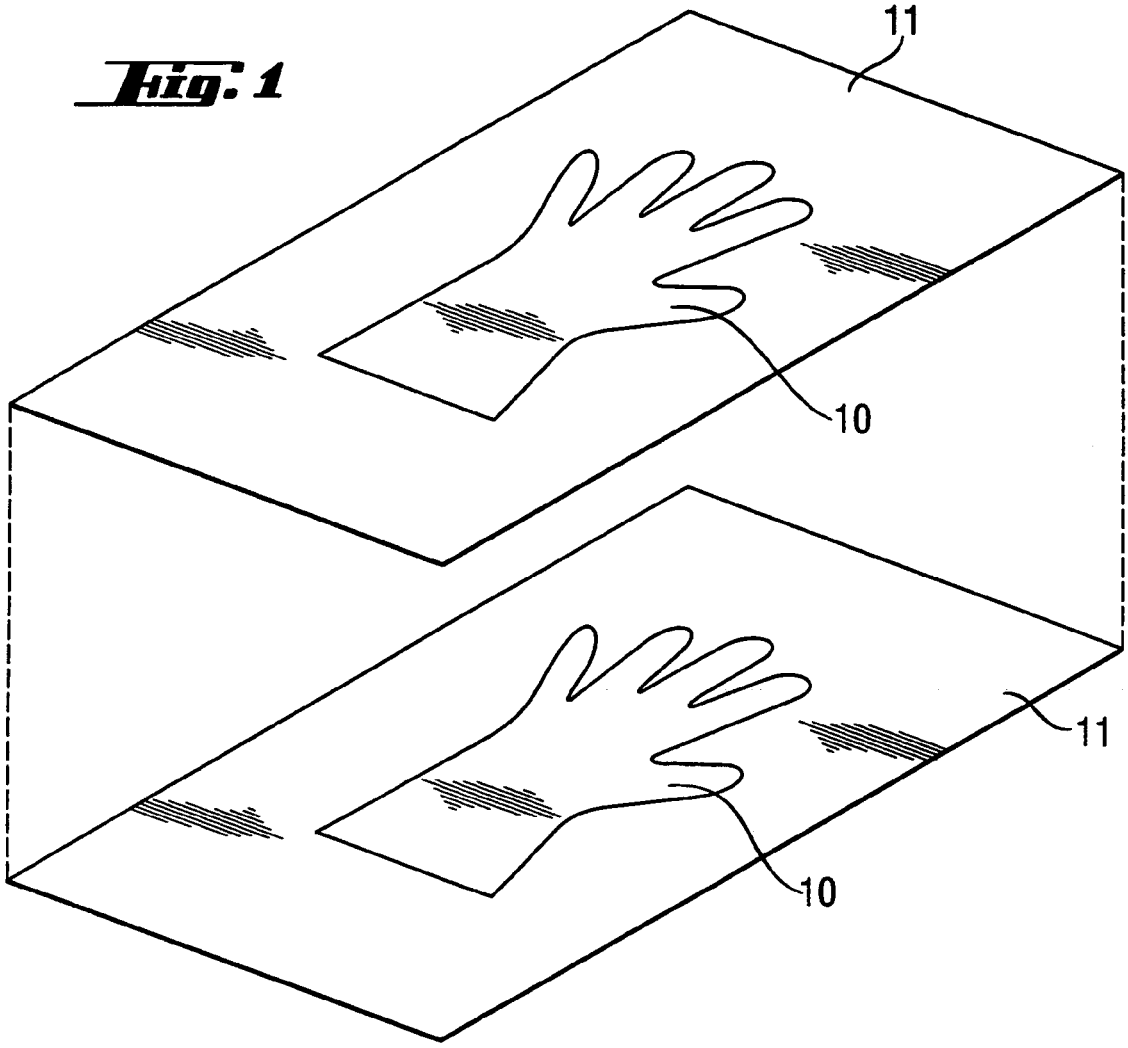
FIG. 1 shows how each side of the insert is formed from a pattern on the laminate and sealed and cut.

As described above, the outer material shell of the handwear and the insert containing the functional layer are directly adhered in a way that reshapes the two dimensional insert by stretching into the three-dimensional form of the shell and thus avoiding folds and bunching. This provides a handcovering which overcomes the deficiencies in the prior art described further above.

The described direct adherence of the shell and the outer side of the functional layer insert to form a glove or mitten prevents the presence of an air layer which can act as a water vapor barrier between the shell and the functional layer insert. Furthermore the minimization of the number of layers ensures a minimum of insulation and a maximum of dexterity. For that and for better stretchability or elongation the functional layer may be directly adhered to the shell material without a protective textile backing. A compounded layer of the whole glove according to the invention, comprising of the regular shell component layer, the adhesive, and the functional insert laminate layer, has a water vapor transmission resistance Ret of less than 35 ($m^2$*Pa)/W or even, in the case of a preferred embodiment, of less than 15 ($m^2$*Pa)/W, depending on the choice of material with regard to outer material and lining material.

The adhering of the shell to the insert can be effected either with adhesive which has been applied in continuous form, i.e., over the whole area, or with adhesive which has been applied discontinuously, i.e. with gaps of >50% of the surface area. In this connection, the adhesive can be applied most conveniently to the outer surfaces of the insert. Water-vapor-permeable adhesive is used in the case of a continuous adhesive layer being applied. For the use of a discontinuous adhesive layer, for example applied in powder, dot, grid or web form, it is possible to use an adhesive that is not water-vapor-permeable. Water vapor permeability is maintained through the area of the insert not covered by the adhesive.

The shell for the glove or mitten of the invention can suitably be, for example, leather or textile sheet materials. Textile sheet materials can be, for example, wovens, knits, nonwovens or felt. These textile sheet materials can be formed from natural fiber, for example cotton or viscose, or from synthetic fiber such as polyester, polyamides, polypropylene or polyolefins, or of blends of at least two of these materials. Such outer materials are normally water permeable and water vapor permeable. To render them water resistant they can be hydrophobicized by treating the shell with a water-repellent material in such a way that the pores of the outer material remain open for water vapor transport.

The adhesive is preferably heat activated and may be selected from a copolyamide, copolyester, polyester polyurethane, polyolefine, polyamide or a polyurethane adhesive, for example such as a reactive polyurethane adhesive, and also mixtures of polyester urethane and polyurethane. The adhesive may have a melting point in the range of 50 to 130° C.

The functional material can be any waterproof, breathable material such as porous polyethylene, polyurethane and the like. Preferably it will be a laminate of a porous polytetrafluoroethylene layer adhered to a cloth lining which feels comfortable on the skin. The porous polytetrafluoroethylene is preferably expanded polytetrafluoroethylene prepared as described in U.S. Pat. No. 3,953,566 and preferably will have a coating of polyurethane that is nonporous but which transports water vapor molecules by molecular transportation. Such a combination is described in U.S. Pat. No. 4,194,041. This combination is adhered to an appropriate textile layer which serves to protect the porous polytetrafluoroethylene layer.

Figure 11:
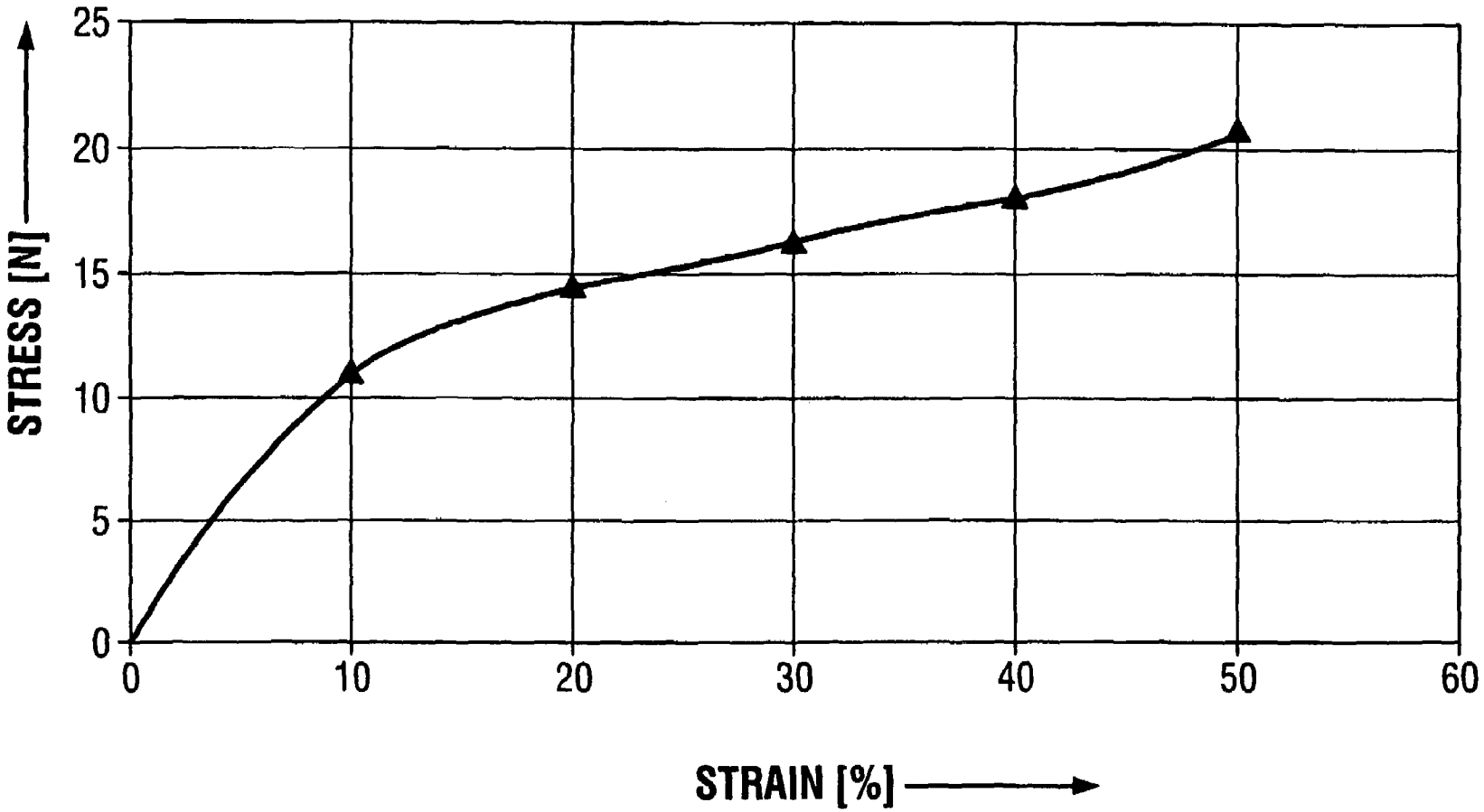
FIG. 11 depicts strain characteristics in relation to stress of a sample piece of an insert.

The lamination of the insert into the shell is done in a way that prevents wrinkling and bunching of the functional layer. The resulting laminate must have a stretchability in at least one direction of at least 30% and preferably 40% in order to allow stretching of the laminate into a three-dimensional shape corresponding to the shape of a hand. Preferably the stretchabilityis in both directions and is mare than 40% The laminate must maintain its waterprootness and water vapor permeability in the stretched condition. To keep the forces for deformation during the stretching and adhering of the insert in the shell low a flat stress strain curve of the laminate (<30 N/5 cm (i.e. related to a sample having a width of 5 cm) for 30% elongation in at least one direction) is necessary. Them is preferably a low recovery of the laminate. FIG. 11 depicts strain characteristics in relation to stress of a sample piece cut from a GORE-TEX® insert having a length (seen in a direction transverse to the longitudinal direction of the insert fingers) of 20 cm, a width of 5 cm, and comprising a layer of ePTFE (expanded polytetralfuoroethylene) and a textile layer of a multifilament polyester knit fabric. The insert material has a weight of 100 $g/m^2$ and the textile layer thereof has a weight of 70 $g/m^2$. The sample piece was stressed in its length direction.

As stated before, the shell is composed of an essentially inelastic outer material which is capable of absorbing restoring forces of the laminate caused by the stretching of the insert. It can easily be tested whether the outer material of handcovering of the present invention had absorbed restoring forces: The finished handcovering is heated to such an extent that the adhesive bonding the insert to the shell liquefies. The shell has absorbed restoring forces if the insert separates from the shell upon liquefaction of the adhesive. Such separation will be detectable in particular in the regions of the finger roots and the thumb back of the handcovering where the three-dimensional shape of the handcovering mostly differs from the two-dimensional shape of a not stretched insert.

Figure 2:
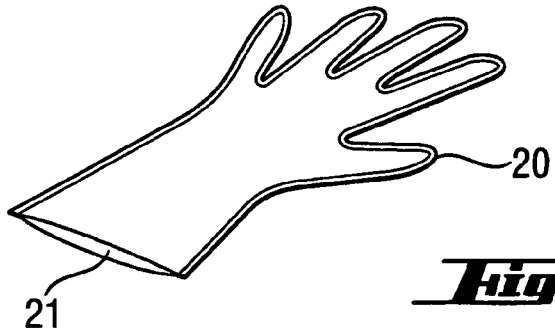
FIG. 2 shows that the two superimposed patterns are sealed around their periphery.

In practice, as seen in FIG. 1, the insert is formed by superimposing two laminates 11 and tracing a pattern 10 in the shape of a hand. The two patterns are then sealed around the periphery 20 as shown in FIG. 2, leaving opening 21 for insertion of a hand. Sealing along the contour can be carried out by applying adhesive, heat and pressure. The sealed shapes are then cut from the laminate patterns. Suitable adhesives include IPATHERM adhesives from H. B. Fuller, ESTANE, TEXIN, PELLETHANE or MORTHANE adhesives. Representative adhesives include a copolyethylene terephthalate, a copolyamide, or a polyurethane.

Figure 3:
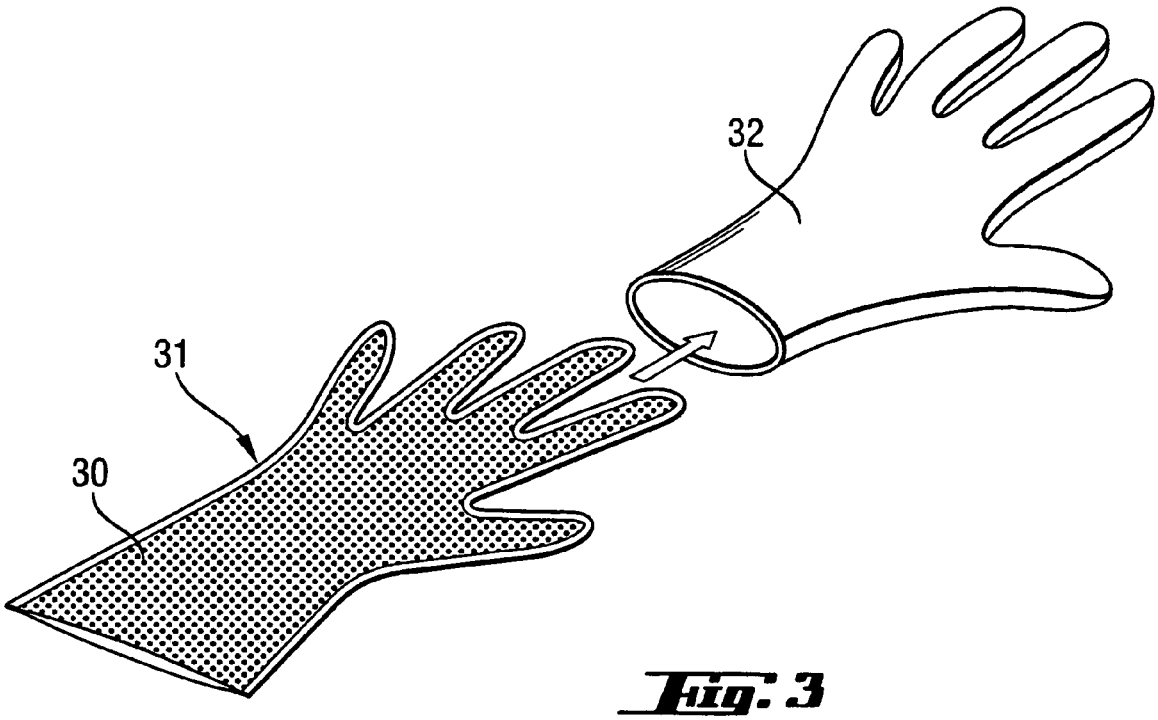
FIG. 3 depicts the placement of the insert just prior to insertion into the shell. The insert is depicted with dots of adhesive on its surface.

The insert so formed can then be treated with adhesive on its two outer surfaces as described above, to ready the insert for insertion in a shell. As shown in FIG. 3, the adhesive is depicted as raised dots 30 on the surface of insert 31. The insert is then moved in the direction of the arrow into shell 32.

The adhesive is heat activatable and is activated either by direct heat, microwave or infra-red.

Figure 4:
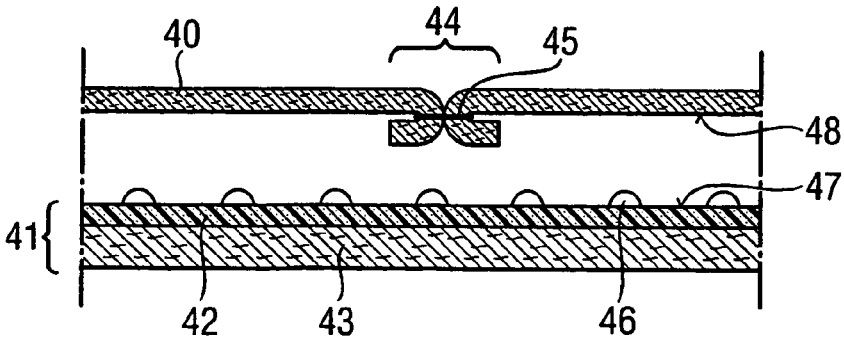
FIG. 4 depicts a cutaway view of a handcovering to expose the shell and insert.

FIG. 4 depicts a cutaway view of the finished handoovering comprising a shell 40 and an insert 41 which are shown in an "exploded view." In practice. of course, the insert is adhered to the shell. In FIG. 4, the insert 41 is shown as comprising a functional layer 42, a textile layer 43 and a seem 44 formed by two abutting shell pieces depicted as 44 in which the joining is achieved by stitching 45. Element 46 depicts the adhesive dots that adhere the shell and the insert. In actual practice, in the end product the outer surface 47 of the insert will abut the inner surface 48 of the shell so that there will be no space to speak of between the shell and the insert. In other words the raised dots in FIG. 4 will be flattened in the final product.

Figure 5:
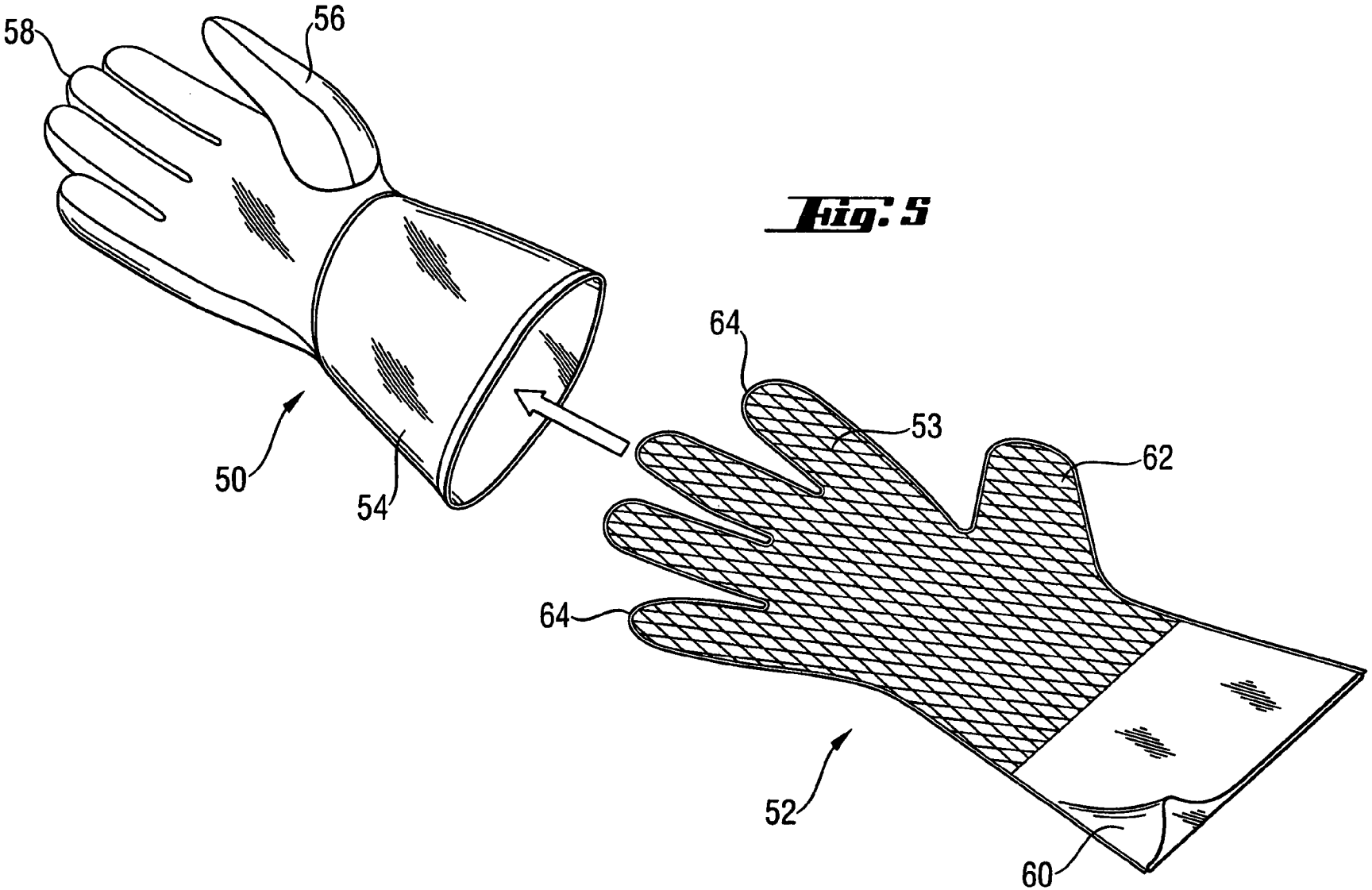
FIG. 5 depicts a modification of FIG. 3.

FIG. 5 depicts a shell 50 and an insert 52, insert 52 being in placement for insertion of insert 52 into shell 50. In this embodiment, adhesive 53 is applied in grid form to the outer surface of insert 52.

Shell 50 comprises a shell gauntlet 54, a shell thumb 56 and shell fingers 58. Shell 50 has a three-dimensional shape. Insert 52 oomprises an insert gauntlet 60, an insert thumb 62 and insert fingers 64. Before insertion into shell 50, insert 52 has a two-dimensional shape.

Insert gauntlet 60 is free of adhesive so that gauntlets 54 and 60 will not be bonded by adhesive to each other.

Figure 6:
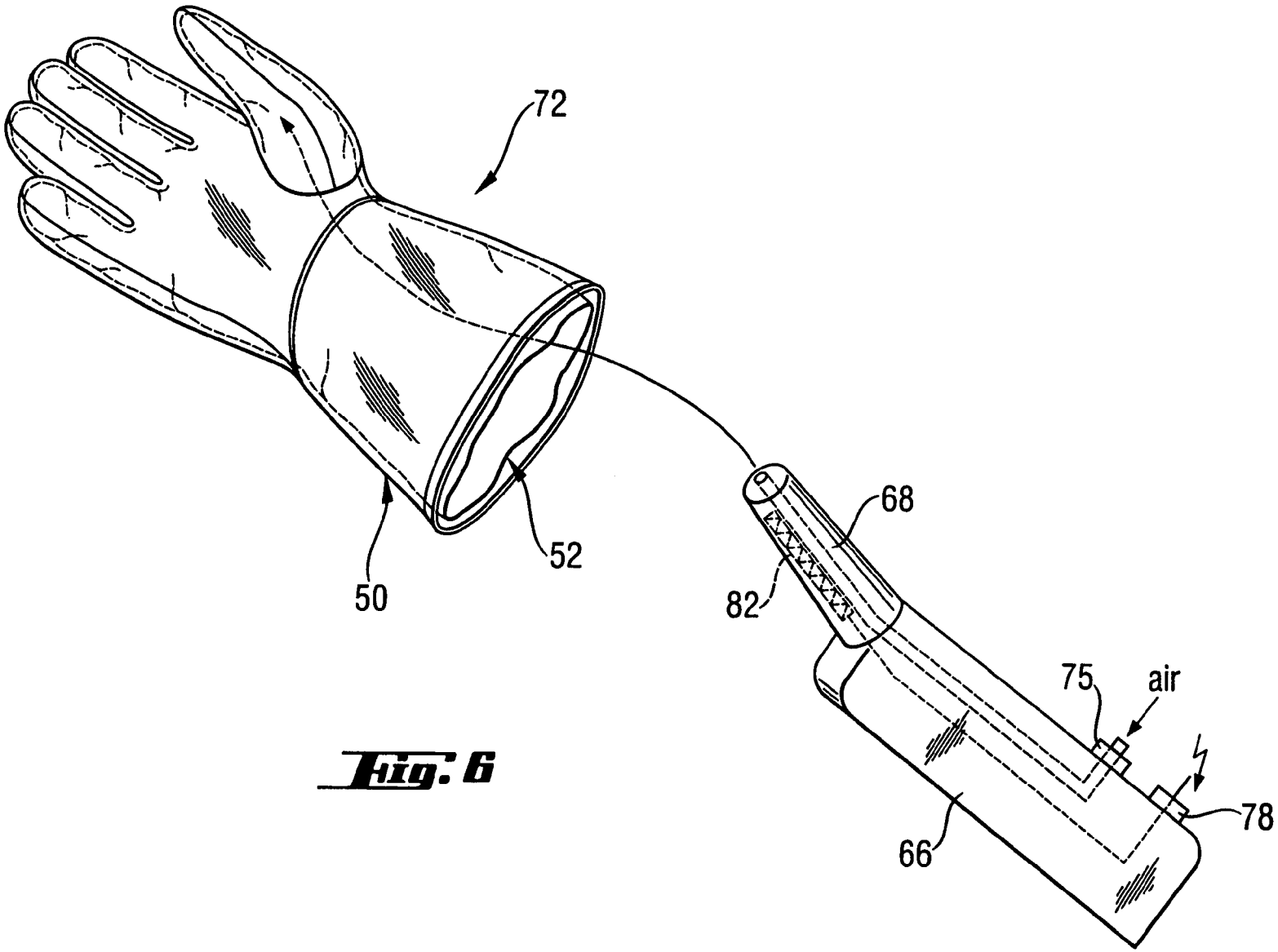
FIG. 6 depicts the shell and the insert before pulling the thumb part thereof over a thumb form.
Figure 7:
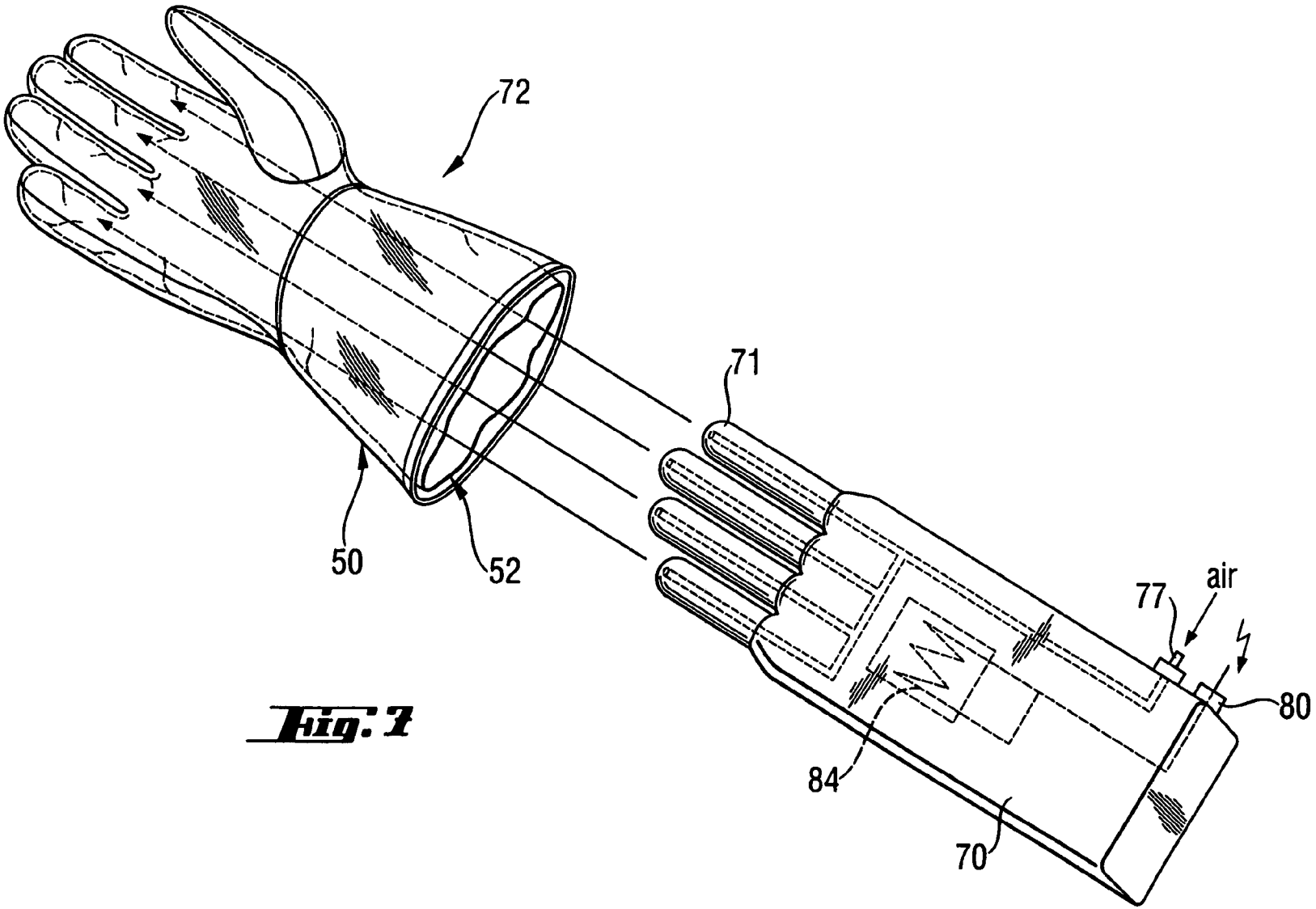
FIG. 7 depicts the shell and the insert before pulling the finger part thereof over a four finger hand form.

In a preferred embodiment of the invention, the heat for activating the adhesive is applied by the means of three dimensional heated forms, preferably rigid and most preferably made of metal. A first form 66 depicted in FIG. 6 has a thumb part 68 having a thumblike shape and a second form 70 shown in FIG. 7 has a finger part 71 having a shape like the remaining hand with four fingers but without thumb. In the case of a mitten the fingers need not to be formed out. The size of forms 66 and 70 must be in accordance with the glove to be produced. The split of the form into two, the thumb and rest is necessary to be able to don a glove shell, which has no or very poor elasticity, on such a tight fitting form.

In the first assembling step insert 52 is put into place in outer glove shell 50 in a manner that all insert fingers 64 are in the respective finger 58 of shell 50. Shell 50 and insert 52 together are then pulled on the two forms 66 and 70 subsequently, being a thumb form 66 and a four finger hand form 70. It is preferred to adhere and fix the thumb area first to anchor the insert 52 and shell 50 during subsequent steps. Heat is then applied to the rest of the combination to adhere insert 52 to shell 50. By pulling the undersized but stretchable insert 52 onto the form 66, 70, the two dimensional insert 52 is stretched into the three-dimensional shape of the form 66, 70 and in this shape is adhered to the glove shell 50. Since the glove shell 50 sits tight on the form 66, 70, the insert 52 is now in the basic shape of the glove 72 and fixed therein.

The forms have a switchable air supply at 75 and 77, respectively. The air is switched on after the adhesive 53 has been activated to cool the activated adhesive 53, to force the insert 52 firmly against the shell 50, which forms the insert exactly after the glove shell 50 and to remove the glove 72 from the form 66, 70 without friction. By using laminate with a flat stress strain curve, a special designed insert pattern and a pressure of up to 0.3 bar, a deformation of the insert 52 is reachable which allows a substantially foldfree fixation of the insert 52 inside the glove shell 50. The insert 52 keeps sustainingly the three-dimensional shape of the glove 72 finally since recovery forces, which tend to pull the insert 52 back into its original shape, are taken over by the glove shell 50.

In an embodiment of the invention, forms 66 and 70 comprise electrical connectors 78 and 80, respectively, for supplying electric heating power to electric heating elements 82 and 84, arranged on or within the respective one of forms 66 and 70.

By this means a unitary handwear is produced that is substantially free of folds or bunching of the insert 52 or the functional layer.

Figure 8:
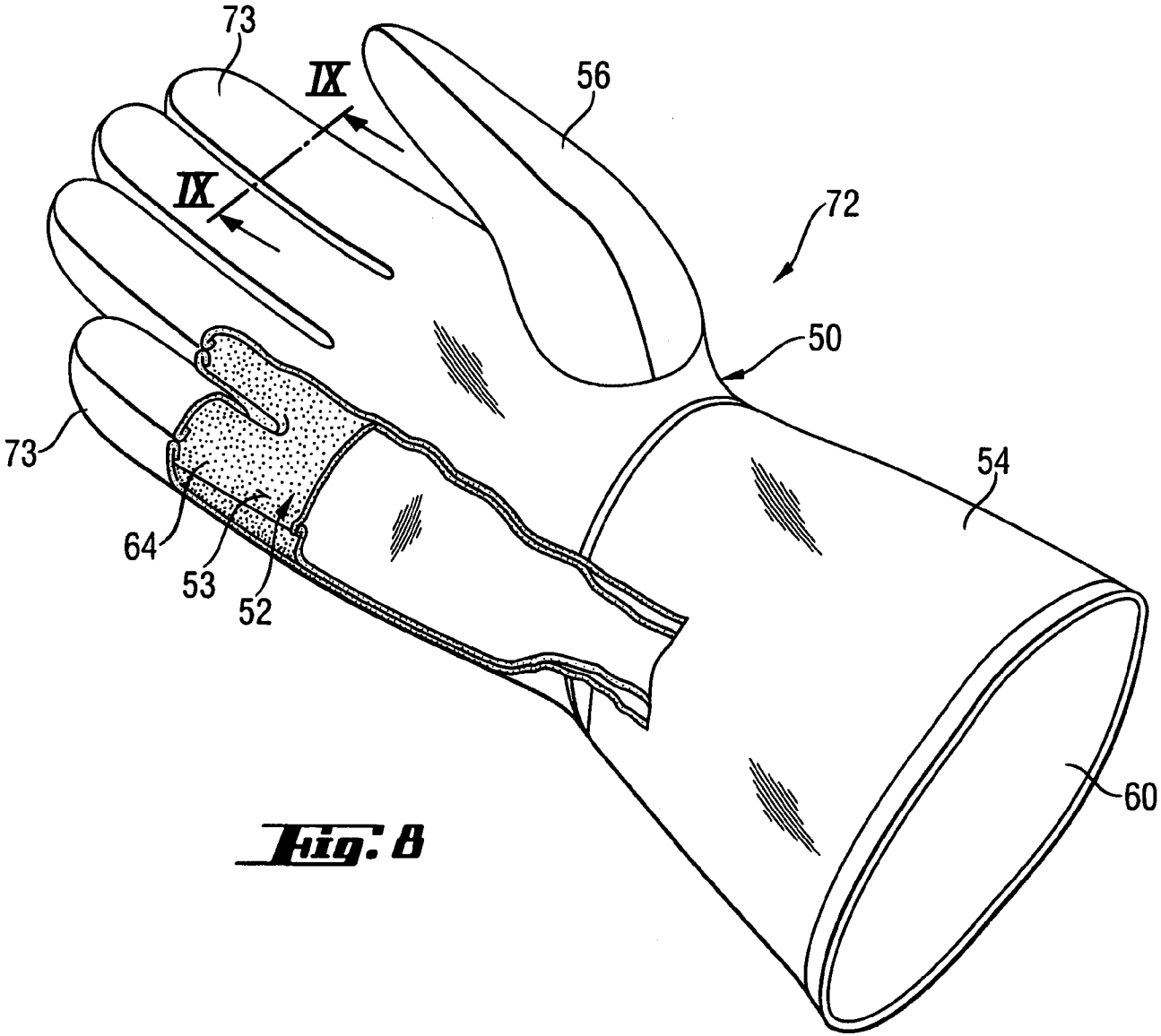
FIG. 8 depicts a finished glove with a portion thereof cut away.

FIG. 8 depicts a finished glove 72 with a part of the glove being cut away to expose interior portions of the finished glove 72, namely a part of insert finger 64, adhesive 53 discontinuously applied to the outer surface of insert 52, and outer shell 50 of glove 72. As can be clearly seen, the finger parts and the hand parts of shell 50 and insert 52 are firmly bonded together, in the embodiment shown by means of dotlike applied adhesive, whereas the shell gauntlet 54 and the insert gauntlet 60 are loosely adjacent to each other.

FIG. 9 depicts a cross section of a glove finger 73 along section line IX—IX in FIG. 8. The shell finger 58 of glove finger 73 consists of four pieces 74 of shell material connected by means of seams 75. Insert finger 64 of glove finger 73 is composed of two pieces of laminate 11 (FIG. 1) comprising functional layer 42 and textile layer 43 and being sealed around the finger periphery by sealing seams 76 (20 in FIG. 2). By stretching the originally two-dimensional laminate material of insert finger 64 into the three-dimensional shell finger 58 and bonding the outer surface of insert finger 64 to the inner surface of shell finger 58 by the adhesive 53, insert finger 64 keeps the three-dimensional shape of shell finger 58 so that insert finger 64 remains substantially free of folds.

What is shown in FIG. 9 and has been explained in the context with glove finger 73 applies to all parts of glove 72 where the insert 52 has been stretched into and bonded to the three-dimensional shell 50.

FIG. 10 depicts the layered structure of finished glove 72 by means of an magnified portion of the cross section of FIG. 9 encircled at X. As it is shown in FIG. 10, insert 52 comprising functional layer 42 and textile layer 43 is bonded to shell 50 by means of adhesive 53.

By the term waterproof is meant that the material under investigation and the welded or sealed area is able to withstand a water ingress pressure of more than 0.05 bar. Preferably, the material can withstand a water pressure of more than 1 bar. The measurement is carried out by exposing a 100 $cm^2$ sample of the material under investigation to a rising water pressure. For this purpose, distilled water having a temperature of 20±2° C. is used. The rise in the water pressure is 60±3 cm $H_2O$/min. The water ingress pressure of the sample is that pressure at which water passes through the opposite side of the sample. The exact method for carrying out this test is described in the 1981 ISO Standard No. 811.

Waterproof as used herein for the glove insert is meant having textile laminates with a water penetration resistance of 0.07 bar or more and whose seams have a penetration resistance of 0.07 bar or more. The waterproofness of the glove insert can be measured using the "Whole Glove Leak Tester" apparatus disclosed in U.S. Pat. No. 4,776,209 (Patchell) assigned to W. L. Gore & Associates, Inc., in which air at pressure of between 0.07 bar and 0.35 bar is admitted into the inside of a glove insert disposed in a water tank.

The term water vapor permeable as used herein is defined via the water vapor transmission resistance Ret of the material so designated. The Ret is a specific material property of sheet-like structures or composites, which determines the "latent" evaporation heat flux through a given area in consequence of an existing steady-state partial pressure gradient. The Ret is defined in German Standard DIN EN 31 092 of February 1994, corresponding to International Standard ISO 11 092, and is expressed in $m^2$*Pa/W (square meters Pascal per watt). For measuring Ret, a measuring head is employed having a temperature of 35° C. at a relative humidity of air of 40%, with an air speed being adjusted to 1 m/s. The water vapor transmission resistance is measured using the Hohenstein skin model test, which is described in standard test method Ne. BPI 1.4 of September 1987 of Bekleidungsphysiologisches Institut e.V. Hohenstein.

The invention claimed is:

1. Handcovering, with an outer material part and with an inner part, wherein:

the inner part comprises a stretchable laminate one layer of which is a waterproof and a water vapor permeable functional layer, the inner part having an outer face;

the outer material pert has a three-dimensional shape corresponding to a hand and a correspondingly three-dimensional inner face; the inner part is stretched into the three-dimensional inner face of the outer material part in such a way that essentially the entire outer face of the inner part rests against the inner face of the outer material part;

essentially the entire outer face of the inner part is bonded essentially to the entire inner face of the outer material part; and the outer material part comprises an essentially inelastic outer material which is capable of absorbing recovery forces of the laminate which are caused by the stretching of the inner part.

2. The handcovering as claimed in claim 1, with a gauntlet extending beyond a wearers wrist in the direction of the wearer's arm.

3. The handcovering as claimed in claim 2, wherein the inner part is not bonded to the outer material part in the region of the gauntlet.

4. The handcovering as claimed In claim 1, wherein the functional layer is selected from the group of substances consisting of polyesters, polyamides, polyolefins including polyethylene and polypropylene, polyvinyl chloride, polyketones, polysulfones, polycarbonates, fluoropolymers including polytetrafluoroethylene (PTFE), polyacrylates, polyurethanes, copolyether esters, and copolyetheramides.

5. The handoovering as claimed in claim 4, wherein the functional layer comprises porous polytetrafluoroethylene.

6. The handeovering as claimed in claim 1, wherein the laminate is provided with a textile layer which is made from knitted fabric comprising of polyethylene terephthalate, polyamide, viscose, cotton or a mixture thereof.

7. The handoovering as claimed in claim 1, wherein the outer material part and the inner part are connected to one another by means of an adhesive.

8. The handoovering of claim 7, wherein the adhesive is discontinuously distributed over the outer surface of the inner part.

9. The handcovering of claim 8, whereby the adhesive is distributed over the outer surface of the inner part in a manner selected from the group consisting of a powder, dot, grid and web form.

10. The handcovering of claim 7, whereby the adhesive is water vapor permeable and continuously distributed over the outer surface of the inner part.

11. The handcovering as claimed in claim 7, comprising an adhesive from the adhesive group consisting of copolyethylene terephthalate, copolyamide, polyolefin and polyurethane.

12. The handcovering as claimed in claim 1, wherein the outer material part comprises at least one material selected from the group consisting of leather, woven fabric, knitted fabric and a fiber nonwoven.

13. The handcovering as claimed in claim 1, wherein the laminate has a stretchability in at least one direction of at least 30%, maintaining the waterproofness and water vapor permeability.

14. The handcovering as claimed in claim 13, wherein the laminate has a stretchability of at least 40%, maintaining the waterproofness and water vapor permeability.

15. The handcovering as claimed in claim 1, wherein the laminate is a two-layer laminate comprising a textile layer.

16. The handcovering as claimed in claim 15, wherein the textile layer is formed by a lining cloth.

17. Unitary handwear comprising:

i) an outer shell comprising an essentially inelastic outer material;

ii) a stretched inner insert adhered to said outer shell such that recovery forces in said insert are restrained by said inelastic outer shell; and iii) wherein the inner insert has a waterproof and water vapor permeable functional layer with an outer surface, whereby the outer surface of the functional layar is directly adhesred to the inner surface of the outer shell.

18. The handwear of claim 17, wherein said inner insert comprises a waterproof and a water vapor permeable laminate.

19. The handwear of claim 18, wherein the laminate comprises a waterproof and a water vapor permeable functional layer.

20. The handwear of claim 19, wherein the functional layer is selected from the group of substances consisting of polyesters, polyamldes, polyolefins including polyethylene and polypropylene, polyvinyl chloride, polyketones, polysulfones, polycarbonates, fluoropolymers including polytetrafluoroethylefle (PTFE), polyacrylates, polyurethanes, copolyether esters, and copolyetherarmides.

21. The handwear of claim 19, wherein the functional layer is porous polytetrafluoroethylene.

22. The handwear of claim 17, wherein the inner insert has a stretchability in at least one direction of at least 30%.

* * * * *

UNITED STATES PATENT AND TRADEMARK OFFICE

CERTIFICATE OF CORRECTION

PATENT NO. : 7,162,748 B2
APPLICATION NO. : 10/182356
DATED : January 16, 2007
INVENTOR(S) : Hottner et al.

It is certified that error appears in the above-identified patent and that said Letters Patent is hereby corrected as shown below:

Column 8, line 23: change “pert” to --part--

Column 8, line 37: change “wearers” to --wearer’s--

Column 8, line 42: change “In” to --in--

Column 8, line 49: change “handoovering” to --handcovering--

Column 8, line 51: change “handeovering” to --handcovering--

Column 8, line 55: change “handoovering” to --handcovering--

Column 8, line 58: change “handoovering” to --handcovering--

Column 10, line 3: change “layar” to --layer--

Column 10, line 4: change “adhesred” to --adhered--

Column 10, line 14: change “polyamldes” to --polyamides--

Column 10, line 17: change “polytetrafluoroethylefle” to --polytetrafluoroethylene--

Column 10, line 18: change “copolyetherarmides” to --copolyetheramides--

Signed and Sealed this

Thirteenth Day of March, 2007

JON W. DUDAS
*Director of the United States Patent and Trademark Office*